US011736882B2

(12) United States Patent
Guérin

(10) Patent No.: US 11,736,882 B2
(45) Date of Patent: Aug. 22, 2023

(54) METHOD FOR INTERPOLATING A SOUND FIELD, CORRESPONDING COMPUTER PROGRAM PRODUCT AND DEVICE

(71) Applicant: FONDATION B-COM, Cesson-Sevigne (FR)

(72) Inventor: Alexandre Guérin, Rennes (FR)

(73) Assignee: FONDATION B-COM, Cesson-Sevigne (FR)

( * ) Notice: Subject to any disclaimer, the term of this patent is extended or adjusted under 35 U.S.C. 154(b) by 233 days.

(21) Appl. No.: 17/413,229

(22) PCT Filed: Dec. 13, 2019

(86) PCT No.: PCT/EP2019/085175
§ 371 (c)(1),
(2) Date: Jun. 11, 2021

(87) PCT Pub. No.: WO2020/120772
PCT Pub. Date: Jun. 18, 2020

(65) Prior Publication Data

US 2022/0132262 A1 Apr. 28, 2022

(30) Foreign Application Priority Data

Dec. 14, 2018 (FR) ..... 1872951

(51) Int. Cl.
*H04S 7/00* (2006.01)

(52) U.S. Cl.
CPC ..... *H04S 7/301* (2013.01); *H04S 7/304* (2013.01); *H04S 2400/15* (2013.01); *H04S 2420/11* (2013.01)

(58) Field of Classification Search
CPC ..... H04S 7/301; H04S 7/304; H04S 2400/15; H04S 2420/11
(Continued)

(56) References Cited

U.S. PATENT DOCUMENTS

2014/0358564 A1* 12/2014 Sen ..... G10L 25/18 704/500

FOREIGN PATENT DOCUMENTS

WO 2018064528 A1 4/2018
WO WO 2018064528 * 4/2018 ..... G60F 17/16

OTHER PUBLICATIONS

International Search Report dated Feb. 24, 2020 for corresponding International Application No. PCT/EP2019/085175, Dec. 13, 2019.
(Continued)

*Primary Examiner* — Yosef K Laekemariam
(74) *Attorney, Agent, or Firm* — David D. Brush; Westman, Champlin & Koehler, P.A.

(57) ABSTRACT

A method for interpolating a sound field captured by a plurality of N microphones each outputting the encoded sound field in a form including at least one captured pressure and an associated pressure gradient vector. Such a method includes an interpolation of the sound field at an interpolation position outputting an interpolated encoded sound field as a linear combination of the N encoded sound fields each weighted by a corresponding weighting factor. The interpolation includes an estimation of the N weighting factors at least from: the interpolation position; a position of each of the N microphones; the N pressures captured by the N microphones; and an estimated power of the sound field at the interpolation position.

18 Claims, 5 Drawing Sheets

(58) Field of Classification Search
USPC ..... 381/26, 56, 58, 122
See application file for complete search history.

(56) References Cited

OTHER PUBLICATIONS

Written Opinion of the International Searching Authority dated Feb. 24, 2020 for corresponding International Application No. PCT/EP2019/085175, filed Dec. 13, 2019.
French Search Report and Written Opinion dated Sep. 18, 2019 for corresponding French Application No. 1872951, filed Dec. 14, 2018.
Tylka Joseph G et al. "Soundfield Navigation using an Array of Higher-Order Ambisonics Microphones" Conference: 2016 AES International Conference on Audio for Virtual and Augmented Reality; Sep. 2016, AES, 60 East 42nd Street, Room 2520 New York 10165-2520, USA, Sep. 21, 2016 (Sep. 21, 2016), XP040681032.
Tylka Joseph G et al. "Comparison of Techniques for Binaural Navigation of Higher-Order Ambisonic Soundfields" AES Convention 139; Oct. 2015, AES, 60 East 42nd Street, Room 2520 New York 10165-2520, USA, Oct. 23, 2015 (Oct. 23, 2015), XP040672273.
Southern A. et al., "Rendering Walk-Through Auralisations Using Wave-Based Acoustical Models" 17th European Signal Processing Conference, Aug. 24-28, 2009, p. 715-719.
International Preliminary Report on Patentability and English translation of the Written Opinion dated Mar. 5, 2020 for corresponding International Application No. PCT/EP2019/085175, filed Dec. 13, 2019.

* cited by examiner

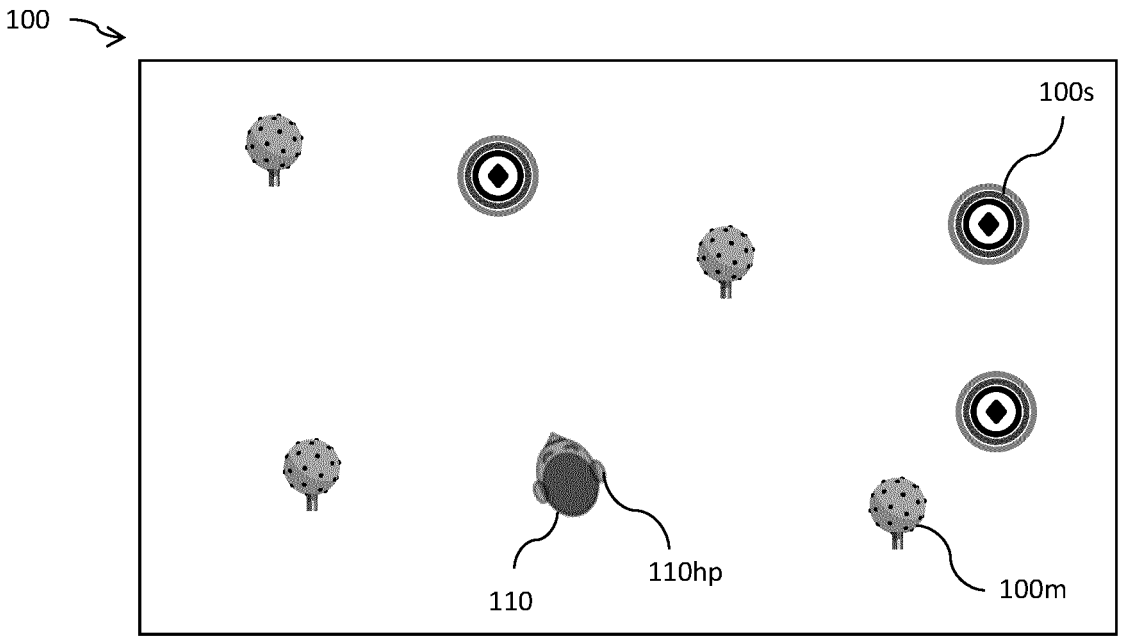
[fig. 1]
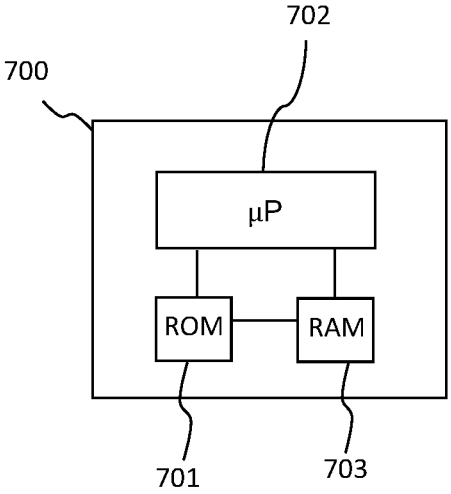
[fig. 7]

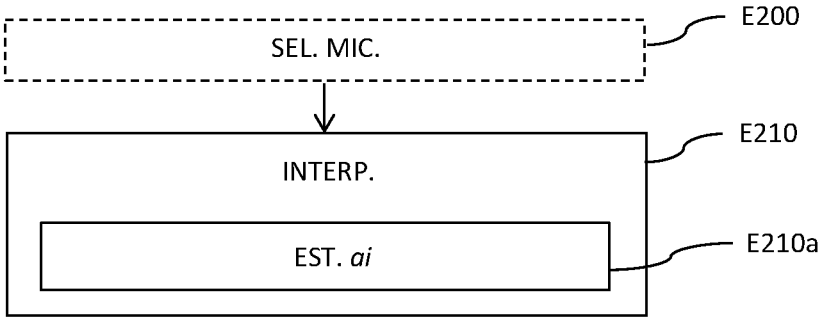
[fig. 2]
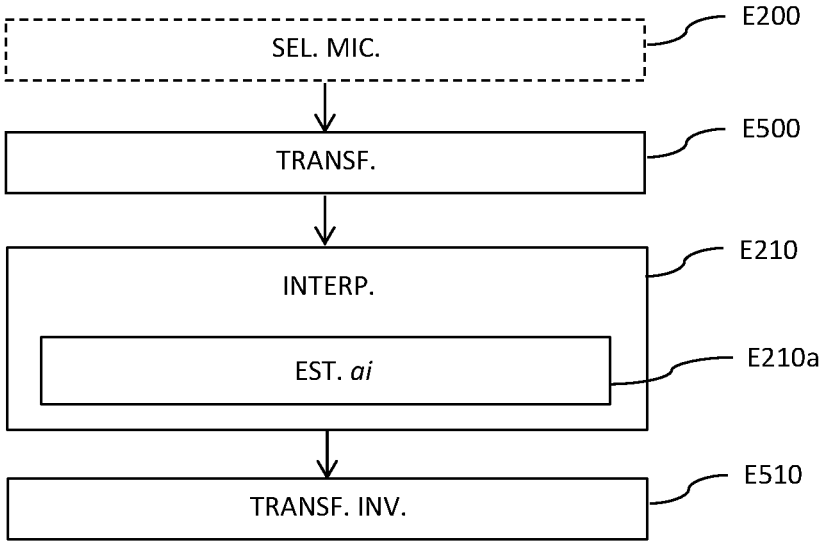
[fig. 5]

[fig. 3a]
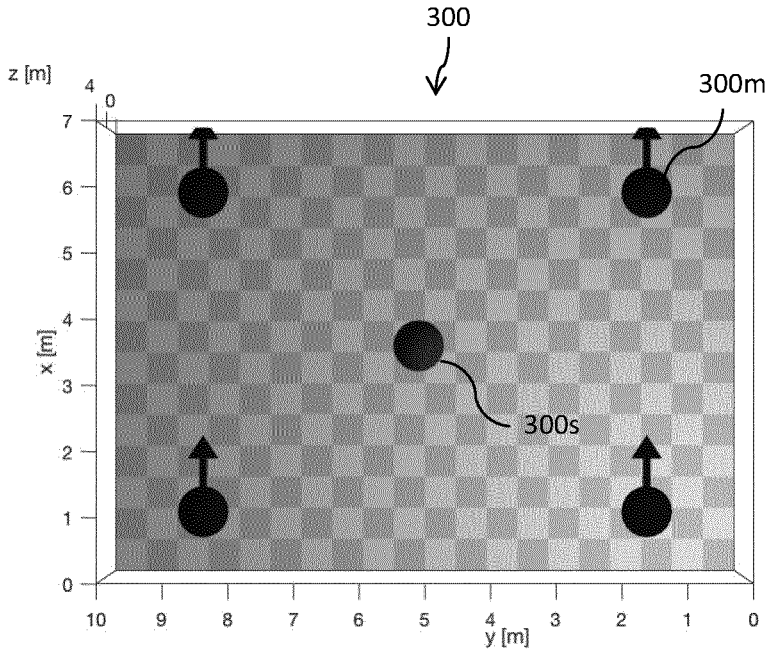
[fig. 3b]
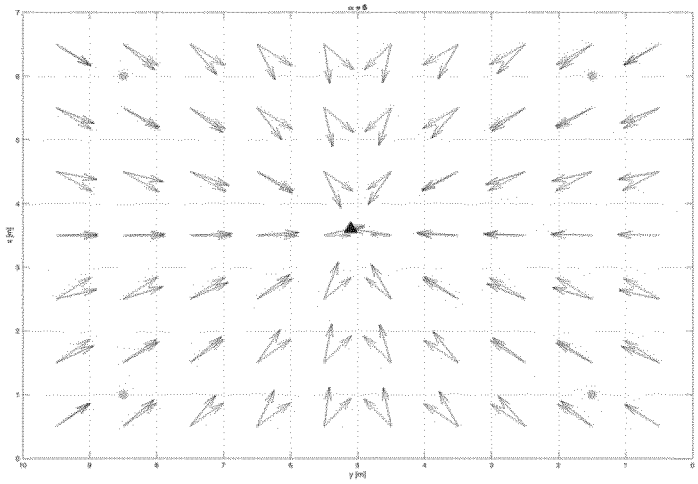
[fig. 3c]
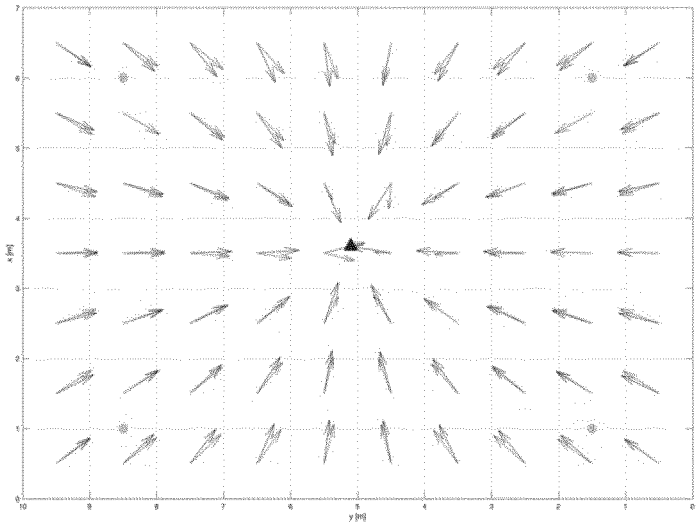

[fig. 4a]
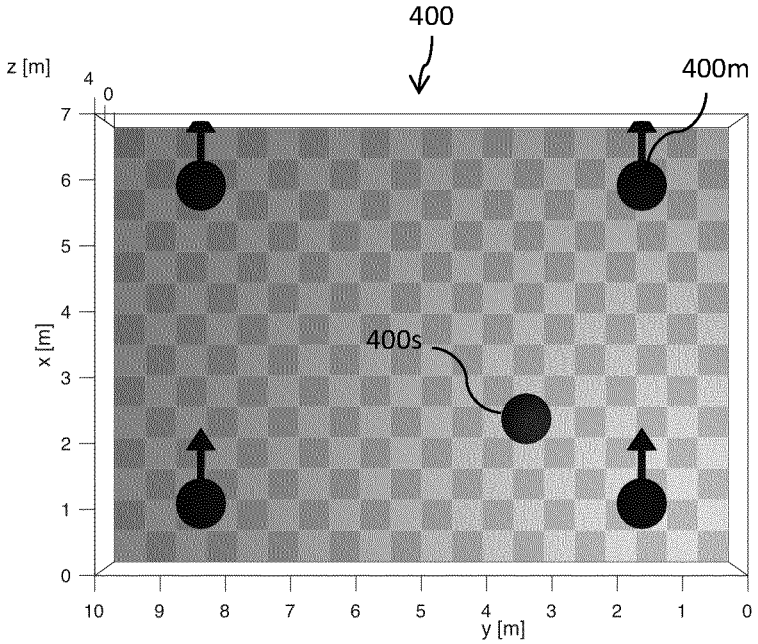
[fig. 4b]
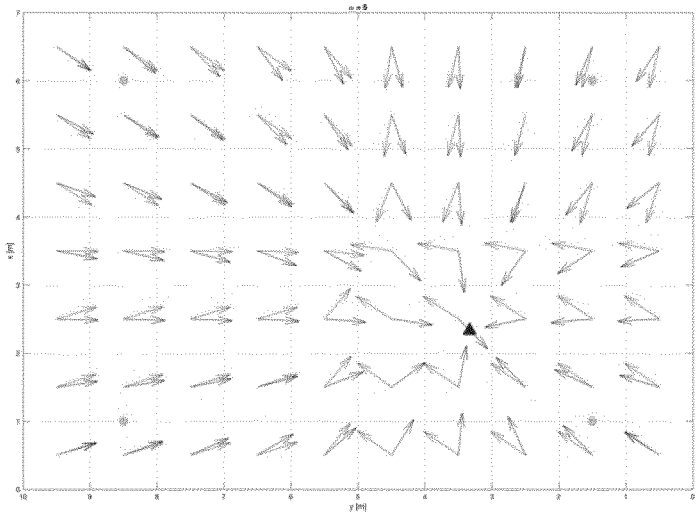
[fig. 4c]
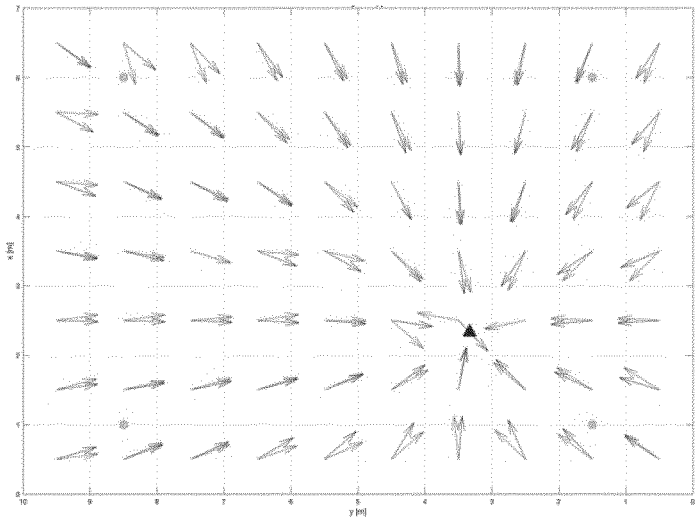

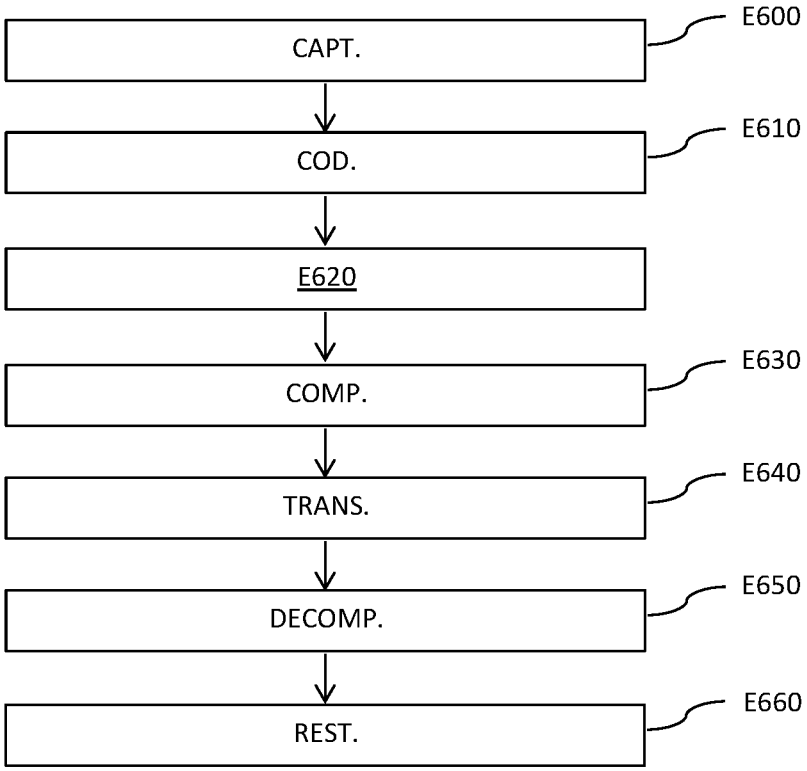
[fig. 6]

METHOD FOR INTERPOLATING A SOUND FIELD, CORRESPONDING COMPUTER PROGRAM PRODUCT AND DEVICE

CROSS-REFERENCE TO RELATED APPLICATIONS

This Application is a Section 371 National Stage Application of International Application No. PCT/EP2019/085175, filed Dec. 13, 2019, which is incorporated by reference in its entirety and published as WO 2020/120772 A1 on Jun. 18, 2020, not in English.

FIELD OF THE INVENTION

The field of the invention pertains to the interpolation of a sound (or acoustic) field having been emitted by one or several source(s) and having been captured by a finite set of microphones.

The invention has numerous application, in particular, but without limitation, in the virtual reality field, for example to enable a listener to move in a sound stage that is rendered to him, or in the analysis of a sound stage, for example to determine the number of sound sources present in the analysed stage, or in the field of rendering a multi-channel scene, for example within a MPEG-H 3D decoder, etc.

THE PRIOR ART AND ITS DRAWBACKS

In order to interpolate a sound field at a given position of a sound stage, a conventional approach consists in estimating the sound field at the given position using a linear interpolation between the fields as captured and encoded by the different microphones of the stage. The interpolation coefficients are estimated while minimising a cost function.

In such an approach, the known techniques favor a capture of the sound field by so-called ambisonic microphones. More particularly, an ambisonic microphone encodes and outputs the sound field captured thereby in an ambisonic format. The ambisonic format is characterised by components consisting of the projection of the sound field according to different directions. These components are grouped in orders. The zero-order encodes the instantaneous acoustic pressure captured by the microphone, the one-order encodes the three pressure gradients according to the three space axes, etc. As we get higher in the orders, the spatial resolution of the representation of the field increases. The ambisonic format in its complete representation, i.e. to the infinite order, allows encoding the filed at every point inside the maximum sphere devoid of sound sources, and having the physical location of the microphone having performed the capture as its center. In theory, using one single microphone, such an encoding of the sound field allows moving inside the area delimited by the source the closest to the microphone, yet without circumventing any of the considered sources.

Thus, such microphones allow representing the sound field in three dimensions through a decomposition of the latter into spherical harmonics. This decomposition is particularly suited to so-called 3DoF (standing for "Degree of Freedom") navigation, for example, a navigation according to the three dimensions. It is actually this format that has been retained for immersive contents on Youtube's virtual reality channel or on Facebook-360.

However, the interpolation methods of the prior art generally assume that there is a pair of microphones at an equal distance from the position of the listener as in the method disclosed in the conference article of A. Southern, J. Wells and D. Murphy: «*Rendering walk-through auralisations using wave-based acoustical models*», 17th European Signal Processing Conference, 2009, p. 715-719». Such a distance equality condition is impossible to guarantee in practice. Moreover, such approaches give interesting results only when the microphones network is dense in the stage, which case is rare in practice.

Thus, there is a need for an improved method for interpolating a sound field. In particular, the method should allow estimating the sound field at the interpolation position so that the considered field is coherent with the position of the sound sources. For example, a listener located at the interpolation position should feel as if the interpolated field actually arrives from the direction of the sound source(s) of the sound stage when the considered field is rendered to him (for example, to enable the listener to navigate in the sound stage).

There is also a need for controlling the computing complexity of the interpolation method, for example to enable a real-time implementation on devices with a limited computing capacity (for example, on a mobile terminal, a virtual reality headset, etc.).

DISCLOSURE OF THE INVENTION

In an embodiment of the invention, a method for interpolating a sound field captured by a plurality of N microphones each outputting said encoded sound field in a form comprising at least one captured pressure and an associated pressure gradient vector, is provided. Such a method comprises an interpolation of said sound field at an interpolation position outputting an interpolated encoded sound field as a linear combination of said N encoded sound fields each weighted by a corresponding weighting factor. The method further comprises an estimation of said N weighting factors at least from:

- the interpolation position;
- a position of each of said N microphones;
- said N pressures captured by said N microphones; and
- an estimated power of said sound field at said interpolation position.

Thus, the invention provides a novel and inventive solution for carrying out an interpolation of a sound field captured by at least two microphones, for example in a stage comprising one or several sound source(s).

More particularly, the proposed method takes advantage of the encoding of the sound field in a form providing access to the pressure gradient vector, in addition to the pressure. In this manner, the pressure gradient vector of the interpolated field remains coherent with that one of the sound field as emitted by the source(s) of the stage at the interpolation position. For example, a listener located at the interpolation position and listening to the interpolated field feels as if the field rendered to him is coherent with the sound source(s) (i.e. the field rendered to him actually arrives from the direction of the considered sound source(s)).

Moreover, the use of an estimated power of the sound field at the interpolation position to estimate the weighting factors allows keeping a low computing complexity. For example, this enables a real-time implementation on devices with a limited computing capacity.

According to one embodiment, the estimation implements a resolution of the equation $\Sigma_i a_i(t)\,\widehat{W_t^2}(t)x_i(t)=\widehat{W_a^2}(t)x_a(t)$, with:

$x_i(t)$ a vector representative of the position of the microphone bearing the index i among the N microphones;

$x_a(t)$ a vector representative of the interpolation position $\widehat{W_a^2}(t)$ the estimate of the power of the sound field at the interpolation position; and $\widehat{W_t^2}(t)$ an estimate of the instantaneous power $W_i^2(t)$ of the pressure captured by the microphone bearing the index i.

For example, the considered equation is solved in the sense of mean squared error minimisation, for example by minimising the cost function $\|\Sigma_i a_i(t)\,\widehat{W_t^2}(t)x_i(t)-\widehat{W_a^2}(t)x_a(t)\|_2$. In practice, the solving method (for example, the Simplex algorithm) is selected according to the overdetermined (more equations than microphones) or underdetermined (more microphones than equations) nature.

According to one embodiment, the resolution is performed with the constraint that $\Sigma_i a_i(t)\,\widehat{W_t^2}(t)=\widehat{W_a^2}(t)$.

According to one embodiment, the resolution is further performed with the constraint that the N weighting factors $a_i(t)$ are positive or zero.

Thus, phase reversals are avoided, thereby leading to improved results. Moreover, solving of the aforementioned equation is accelerated.

According to one embodiment, the estimation also implements a resolution of the equation $\alpha\Sigma_i a_i(t)\,\widehat{W_t^2}(t)=\alpha\,\widehat{W_a^2}(t)$, with $\alpha$ a homogenisation factor.

According to one embodiment, the homogenisation factor $\alpha$ is proportional to the L−2 norm of the vector $x_a(t)$.

According to one embodiment, the estimation comprises:

a time averaging of said instantaneous power $W_i^2(t)$ over a predetermined period of time outputting said estimate $\widehat{W_t^2}(t)$; or an autoregressive filtering of time samples of said instantaneous power $W_i^2(t)$, outputting said estimate $\widehat{W_t^2}(t)$.

Thus, using the effective power, the variations of the instantaneous power $W_i^2(t)$ are smoothed over time. In this manner, noise that might entail the weighting factors is reduced during estimation thereof. Thus, the interpolated sound field is even more stable.

According to one embodiment, the estimate $\widehat{W_a^2}(t)$ of the power of the sound field at the interpolation position is estimated from the instantaneous sound power $W_i^2(t)$ captured by that one among the N microphones the closest to the interpolation position or from the estimate $\widehat{W_t^2}(t)$ of the instantaneous sound power $W_i^2(t)$ captured by that one among the N microphones the closest to the interpolation position.

According to one embodiment, the estimate $\widehat{W_a^2}(t)$ of the power of the sound field at the interpolation position is estimated from a barycentre of the N instantaneous sound powers $W_i^2(t)$ captured by the N microphones, respectively from a barycentre of the N estimates $\widehat{W_t^2}(t)$ of the N instantaneous sound powers $W_i^2(t)$ captured by the N microphones. A coefficient weighting the instantaneous sound power $W_i^2(t)$, respectively weighting the estimate $\widehat{W_t^2}(t)$ of the instantaneous sound power $W_i^2(t)$ captured by the microphone bearing the index i, in the barycentre being inversely proportional to a normalised version of the distance between the position of the microphone bearing the index i outputting the pressure $W_i(t)$ the said interpolation position. The distance is expressed in the sense of a L-p norm.

Thus, the pressure of the sound field at the interpolation position is accurately estimated based on the pressures output by the microphones. In particular, when p is selected equal to two, the decay law of the pressure of the sound field is met, leading to good results irrespective of the configuration of the stage.

According to one embodiment, the interpolation method further comprises, prior to the interpolation, a selection of the N microphones among Nt microphones, Nt>N.

Thus, the weighting factors may be obtained through a determined or overdetermined system of equations, thereby allowing avoiding or, to the least, minimising timbre changes that are perceptible by the ear, over the interpolated sound field.

According to one embodiment, the N selected microphones are those the closest to the interpolation position among the Nt microphones.

According to one embodiment, the selection comprises:

a selection of two microphones bearing the indexes $i_1$ and $i_2$ the closest to said interpolation position among said Nt microphones;

a calculation of a median vector $u_{12}(t)$ having as an origin said interpolation position and pointing between the positions of the two microphones bearing the indexes $i_1$ and $i_2$; and a determination of a third microphone bearing the index $i_3$ different from said two microphones bearing the indexes is and $i_2$ among the Nt microphones and whose position is the most opposite to the median vector $u_{12}(t)$.

Thus, the microphones are selected so as to be distributed around the interpolation position.

According to one embodiment, the median vector $u_{12}(t)$ is expressed as $$u_{12}(t)=\frac{(x_{i_2}(t)-x_a(t)+x_{i_1}(t)-x_a(t))}{\|(x_{i_2}(t)-x_a(t)+x_{i_1}(t)-x_a(t))\|},$$

with $x_a(t)$ the vector representative of the interpolation position, $x_{i_1}(t)$ a vector representative of the position of the microphone bearing the index $i_1$, and $x_{i_2}(t)$ a vector representative of the position of the microphone bearing the index $i_2$. The index $i_3$ of the third microphone is an index different from $i_1$ and $i_2$ which minimises the scalar product $$\left\langle u_{12}(t),\ \frac{x_i(t)-x_a(t)}{\|x_i(t)-x_a(t)\|}\right\rangle$$

among the Nt indexes of the microphones.

According to one embodiment, the interpolation method further comprises, for given encoded sound field among the N encoded sound fields output by the N microphones, a transformation of the given encoded sound field by application of a perfect reconstruction filter bank outputting M field frequency components associated to the given encoded sound field, each field frequency component among the M field frequency components being located in a distinct frequency sub-band. The transformation repeated for the N encoded sound fields outputs N corresponding sets of M field frequency components. For a given frequency sub-band among the M frequency sub-bands, the interpolation outputs a field frequency component interpolated at the interpolation position and located within the given frequency sub-band, the interpolated field frequency component being expressed as a linear combination of the N field frequency components, among the N sets, located in the given frequency sub-band. The interpolation repeated for the M frequency sub-bands outputs M interpolated field frequency components at the interpolation position, each interpolated field frequency component among the M interpolated field frequency components being located in a distinct frequency sub-band.

Thus, the results are improved in the case where the sound field is generated by a plurality of sound sources.

According to one embodiment, the interpolation method further comprises an inverse transformation of said transformation. The inverse transformation applied to the M interpolated field frequency components outputs the interpolated encoded sound field at the interpolation position.

According to one embodiment, the perfect reconstruction filter bank belongs to the group comprising:

DFT (standing for "Discrete Fourier Transform");

QMF (standing for "Quadrature Mirror Filter");

PQMF (standing for "Pseudo—Quadrature Mirror Filter"); and

MDCT (standing for "Modified Discrete Cosine Transform").

The invention also relates to a method for rendering a sound field. Such a method comprises:

capturing the sound field by a plurality of N microphones each outputting a corresponding captured sound field;

encoding of each of the captured sound fields outputting a corresponding encoded sound field in a form comprising at least one captured pressure and an associated pressure gradient vector;

an interpolation phase implementing the above-described interpolation method (according to any one of the aforementioned embodiments) outputting the interpolated encoded sound field at the interpolation position;

a compression of the interpolated encoded sound field outputting a compressed interpolated encoded sound field;

a transmission of the compressed interpolated encoded sound field to at least one rendering device;

a decompression of the received compressed interpolated encoded sound field; and rendering the interpolated encoded sound field on said at least one rendering device.

The invention also relates to a computer program, comprising program code instructions for the implementation of an interpolation or rendering method as described before, according to any one of its different embodiments, when said program is executed by a processor.

In another embodiment of the invention, a device for interpolating a sound field captured by a plurality of N microphones each outputting the encoded sound field in a form comprising at least one captured pressure and an associated pressure gradient vector. Such an interpolation device comprises a reprogrammable computing machine or a dedicated computing machine, adapted and configured to implement the steps of the previously-described interpolation method (according to any one of its different embodiments).

Thus, the features and advantages of this device are the same as those of the previously-described interpolation method. Consequently, they are not detailed further.

LIST OF FIGURES

Other objects, features and advantages of the invention will appear more clearly upon reading the following description, provided merely as an illustrative and non-limiting example, with reference to the figures, among which:

FIG. 1 represents a sound stage wherein a listener moves, a sound field having been diffused by sound sources and having been captured by microphones;

FIG. 2 represents the steps of a method for interpolating the sound field captured by the microphones of [FIG. 1] according to an embodiment of the invention;

FIG. 3*a* represents a stage wherein a sound field is diffused by a unique sound source and is captured by four microphones according to a first configuration;

FIG. 3*b* represents a mapping of the opposite of the normalised acoustic intensity in the 2D plane generated by the sound source of the stage of [FIG. 3*a*] as well as a mapping of the opposite of the normalised acoustic intensity as estimated by a known method from the quantities captured by the four microphones of [FIG. 3*a*];

FIG. 3*c* represents a mapping of the opposite of the normalised acoustic intensity in the 2D plane generated by the sound source of the stage of [FIG. 3*a*] as well as a mapping of the opposite of the normalised acoustic intensity as estimated by the method of figure [FIG. 2] from the quantities captured by the four microphones of [FIG. 3*a*];

FIG. 4*a* represents another stage wherein a sound field is diffused by a unique sound source and is captured by four microphones according to a second configuration;

FIG. 4*b* represents a mapping of the opposite of the normalised acoustic intensity in the 2D plane generated by the sound source of the stage of [FIG. 4*a*] as well as a mapping of the opposite of the normalised acoustic intensity of the sound field as estimated by a known method from the quantities captured by the four microphones of [FIG. 4*a*];

FIG. 4*c* represents a mapping of the opposite of the normalised acoustic intensity in the 2D plane generated by the sound source of the stage of [FIG. 4*a*] as well as a mapping of the opposite of the normalised acoustic intensity of the sound field as estimated by the method of figure [FIG. 2] from the quantities captured by the four microphones of [FIG. 4*a*];

FIG. 5 represents the steps of a method for interpolating the sound field captured by the microphones of [FIG. 1] according to another embodiment of the invention;

FIG. 6 represents the steps of a method for rendering, to the listener of [FIG. 1], the sound field captured by the microphones of [FIG. 1] according to an embodiment of the invention;

FIG. 7 represents an example of a structure of an interpolation device according to an embodiment of the invention.

DETAILED DESCRIPTION OF EMBODIMENTS OF THE INVENTION

In all figures of the present document, identical elements and steps bear the same reference numeral.

The general principle of the invention is based on encoding of the sound field by the microphones capturing the considered sound field in a form comprising at least one captured pressure and an associated pressure gradient. In this manner, the pressure gradient of the field interpolated through a linear combination of the sound fields encoded by the microphones remains coherent with that of the sound field as emitted by the source(s) of the scene at the interpolation position. Moreover, the method according to the invention bases the estimation of the weighting factors involved in the considered linear combination on an estimate of the power of the sound field at the interpolation position. Thus, a low computing complexity is obtained.

In the following, a particular example of application of the invention to the context of navigation of a listener in a sound stage is considered. Of course, it should be noted that the invention is not limited to this type of application and may advantageously be used in other fields such as the rendering of a multi-channel scene, the compression of a multi-channel scene, etc.

Moreover, in the present application:

- the term encoding (or coding) is used to refer to the operation of representing a physical sound field captured by a given microphone according to one or several quantities according to a predefined representation format. For example, such a format is the ambisonic format described hereinabove in connection with the "The prior art and its drawbacks" section. The reverse operation then amounts to a rendering of the sound field, for example on a loudspeaker-type device which converts samples of the sound fields in the predefined representation format into a physical acoustic field; and
- the term compression is, in turn, used to refer to a processing aiming to reduce the amount of data necessary to represent a given amount of information. For example, it consists of an "entropic coding" type processing (for example, according to the MP3 standard) applied to the samples of the encoded sound field. Thus, the term decompression corresponds to the reverse operation.

As of now, a sound stage 100 wherein a listener 110 moves, a sound field having been diffused by sound sources 100*s* and having been captured by microphones 100*m* are presented, with reference to [FIG. 1].

More particularly, the listener 110 is provided with a headset equipped with loudspeakers 110*hp* enabling rendering of the interpolated sound field at the interpolation position occupied thereby. For example, it consists of Hi-Fi headphones, or a virtual reality headset such as Oculus, HTC Vive or Samsung Gear. In this instance, the sound field is interpolated and rendered through the implementation of the rendering method described hereinbelow with reference to [FIG. 6].

Moreover, the sound field captured by the microphones 100*m* is encoded in a form comprising a captured pressure and an associated pressure gradient.

In other non-illustrated embodiments, the sound field captured by the microphones is encoded in a form comprising the captured pressure, the associated pressure gradient vector as well as all or part of the higher order components of the sound field in the ambisonic format.

Back to [FIG. 1], the perception of the direction of arrival of the wavefront of the sound field is directly correlated with an acoustic intensity vector $\vec{I}(t)$ which measures the acoustic energy instantaneous flow through an elementary surface. The considered intensity vector is equal to the product of the instantaneous acoustic pressure W(t) by the particle velocity, which is opposite to the pressure gradient vector B(t). This pressure gradient vector may be expressed in 2D or 3D depending on whether it is desired to displace and/or perceive the sounds in 2D or 3D In the following, the 3D case is considered, the derivation of the 2D case being obvious. In this case, the gradient vector is expressed as a 3-dimensional vector: $B(t)=[X(t)\ Y(t)\ Z(t)]^T$. Thus, in the considered formalism where the sound field is encoded in a form comprising the captured pressure and the associated pressure gradient vector (while considering a multiplying coefficient):

$$\vec{I}(t) = -W(t)\begin{bmatrix} X(t) \\ Y(t) \\ Z(t) \end{bmatrix}.$$

It is shown that this vector is orthogonal to the wavefront and points in the direction of propagation of the sound wave, namely opposite to the position of the emitter source: this way, it is directly correlated with the perception of the wavefront. This is particularly obvious when considering a field generated by one single punctual and far source s(t) propagating in an anechoic environment. The ambisonics theory states that, for such a plane wave with an incidence (ϑ, φ), where ϑ is the azimuth and p the elevation, the first-order sound field is given by the following equation:

$$\begin{cases} W(t) = s(t) \\ X(t) = \cos\theta\cos\varphi s(t) \\ Y(t) = \sin\theta\cos\varphi s(t) \\ Z(t) = \sin\varphi s(t) \end{cases}.$$

In this case, the full-band acoustic intensity $\vec{I}(t)$ is equal (while considering a multiplying coefficient), to:

$$\vec{I}(t) = -\begin{bmatrix} \cos\theta\cos\varphi \\ \sin\theta\cos\varphi \\ \sin\varphi \end{bmatrix} s^2(t).$$

Hence, we see that it points to the opposite of the direction of the emitter source and the direction of arrival (ϑ, φ) of the wavefront may be estimated by the following trigonometric relationships:

$$\begin{cases} \theta = \arctan\left(\dfrac{WY}{WX}\right) \\ \varphi = \arctan\left(\dfrac{WZ}{\sqrt[2]{(WX)^2 + (WY)^2}}\right) \end{cases}.$$

As of now, a method for interpolating the sound field captured by the microphones 100*m* of the stage 100 according to an embodiment of the invention is presented, with reference to [FIG. 2].

Such a method comprises a step E200 of selecting N microphones among the Nt microphones of the stage 100. It should be noted that in the embodiment represented in [FIG. 1], Nt=4. However, in other non-illustrated embodiments, the considered stage may comprise a different number Nt of microphones.

More particularly, as discussed hereinbelow in connection with steps E210 and E210*a*, the method according to the invention implements the resolution of systems of equations (i.e. [math 4] in different constraints alternatives (i.e. hyperplan and/or positive weighting factors) and [Math 5]). In practice, it turns out that the resolution of the considered systems in the case where they are underdetermined (which case corresponds to the configuration where there are more microphones 100*m* than equations to be solved) leads to solutions that might favor different sets of microphones, over time. While the location of the sources 100*s* as perceived via the interpolated sound field is still coherent, there are nevertheless timbre changes that are perceptible by the ear. These differences are due: i) to the colouring of the reverberation which is different from one microphone 100*m* to another; ii) to the comb filtering induced by the mixture of non-coincident microphones 100*m*, which filtering has different characteristics from one set of microphones to another.

To avoid such timber changes, N microphones 100*m* are selected while always ensuring that the mixture is determined, and even overdetermined. For example, in the case of a 3D interpolation, it is possible to select up to three microphones among the Nt microphones 100*m*.

In one variant, the N microphones 100*m* that are the closest to the position to be interpolated are selected. This solution should be preferred when a large number Nt of microphones 110*m* is present in the stage. However, in some cases, the selection of the closest N microphones 110*m* could turn out to be "imbalanced" considering the interpolation position with respect to the source 100*s* and lead to a total reversal of the direction of arrival: this is the case in particular when the source 100*s* is placed between the microphones 100*m* and the interpolation position.

To avoid this situation, in another variant, the N microphones are selected distributed around the interpolation position. For example, we select the two microphones bearing the indexes $i_1$ and $i_2$ that are the closest to the interpolation position among the Nt microphones 100*m*, and then we look among the remaining microphones for that one that maximises the "enveloping" of the interpolation position. To achieve this, step E200 comprises for example:

- a selection of two microphones bearing the indexes $i_1$ and $i_2$ that are the closest to the interpolation position among the Nt microphones 110*m;*
- a calculation of a median vector $u_{12}(t)$ having the interpolation position as an origin and pointing between the positions of the two microphones bearing the indexes $i_1$ and $i_2$; and
- a determination of a third microphone bearing an index $i_3$ different from the two microphones bearing the indexes $i_1$ and $i_2$ among the Nt microphones 110*m* and whose position is the most opposite to the median vector $u_{12}(t)$.

For example, the median vector $u_{12}(t)$ is expressed as:

$$u_{12}(t) = \frac{(x_{i_2}(t) - x_a(t) + x_{i_1}(t) - x_a(t))}{\|(x_{i_2}(t) - x_a(t) + x_{i_1}(t) - x_a(t))\|}$$

with:

- $x_a(t)=(x_a(t)\ y_a(t)\ z_a(t))^T$ a vector representative of the interpolation position (i.e. the position of the listener 110 in the embodiment represented in [FIG. 1]);
- $x_{i_1}(t)=(x_{i_1}(t)\ y_{i_1}(t)\ z_{i_1}(t))^T$ a vector representative of the position of the microphone bearing the index $i_1$; and
- $x_{i_2}(t)=(x_{i_2}(t)\ y_{i_2}(t)\ z_{i_2}(t))^T$ a vector representative of the position of the microphone bearing the index $i_2$, the considered vectors being expressed in a given reference frame.

In this case, the index $i_3$ of said third microphone is, for example, an index different from $i_1$ and $i_2$ which minimises the scalar product $$\left\langle u_{12}(t), \frac{x_i(t) - x_a(t)}{\|x_i(t) - x_a(t)\|} \right\rangle$$

among the Nt indexes of the microphones 100*m*. Indeed, the considered scalar product varies between −1 and +1, and it is minimum when the vectors $u_{12}(t)$ and $$\frac{x_i(t) - x_a(t)}{\|x_i(t) - x_a(t)\|}$$

are opposite to one another, that is to say when the 3 microphones selected among the Nt microphones 110*m* surround the interpolation position.

In other embodiments that are not illustrated in [FIG. 2], the selection step E200 is not implemented and steps E210 and E210*a* described hereinbelow are implemented based on the sound fields encoded by all of the Nt microphones 100*m*. In other words, N=Nt for the implementation of steps E210 and E210*a* in the considered other embodiments.

Back to [FIG. 2], the method comprises a step E210 of interpolating the sound field at the interpolation position, outputting an interpolated encoded sound field expressed as a linear combination of the N sound fields encoded by the selected N microphones 100*m*, each of the N encoded sound fields being weighted by a corresponding weighting factor.

Thus, in the embodiment discussed hereinabove with reference to [FIG. 1], wherein the sound field captured by the selected N microphones 100*m* is encoded in a form comprising a captured pressure and the associated pressure gradient vector, it is possible to write the linear combination of the N encoded sound fields in the form:

$$\begin{pmatrix} W_a(t) \\ X_a(t) \\ Y_a(t) \\ Z_a(t) \end{pmatrix} = \sum_i a_i(t) \begin{pmatrix} W_i(t) \\ X_i(t) \\ Y_i(t) \\ Z_i(t) \end{pmatrix}, \quad \text{[Math 1]}$$

with:

- $(W_i(t)\ X_i(t)\ Y_i(t)\ Z_i(t))^T$ the column vector of the field in the encoded format output by the microphone bearing the index i, i an integer from 1 to N;
- $(W_a(t)\ X_a(t)\ Y_a(t)\ Z_a(t))^T$ the column vector of the field in the encoded format at the interpolation position (for example, the position of the listener 110 in the embodiment illustrated in [FIG. 1]); and
- $a_i(t)$ the weighting factor weighting the field in the encoded format output by the microphone bearing the index i in the linear combination given by [Math 1].

In other embodiments that are not illustrated in [FIG. 1] where the sound field captured by the microphones is encoded in a form comprising the captured pressure, the associated pressure gradient vector as well as all or part of the higher-order components of the sound field decomposed in the ambisonic format, the linear combination given by [Math 1] is re-written in a more general way as:

$$\begin{pmatrix} W_a(t) \\ X_a(t) \\ Y_a(t) \\ Z_a(t) \\ \vdots \end{pmatrix} = \sum_i a_i(t) \begin{pmatrix} W_i(t) \\ X_i(t) \\ Y_i(t) \\ Z_i(t) \\ \vdots \end{pmatrix},$$

where the dots refer to the higher-order components of the sound field decomposed in the ambisonic format.

Regardless of the embodiment considered for encoding of the sound field, the interpolation method according to the invention applies in the same manner in order to estimate the weighting factors $a_i(t)$.

For this purpose, the method of [FIG. 2] comprises a step E210*a* of estimating the N weighting factors $a_i(t)$ so as to have the pressure gradients estimated at the interpolation position, represented by the vector $\widehat{B_a}=(\widehat{X_a}(t)\ \widehat{Y_a}(t)\ \widehat{Z_a}(t))^T$, coherent relative to the position of the sources 100*s* present in the sound stage 100.

More particularly, in the embodiment of [FIG. 2], it is assumed that only one of the sources 100*s* is active at one time. Indeed, in his case and as long as the reverberation is sufficiently contained, the captured field at any point of the stage 100 may be considered as a plane wave. In this manner, the first-order components (i.e. the pressure gradients) are inversely proportional to the distance between the active source 100*s* and the measurement point, for example the microphone 100*m* bearing the index i, and points from the active source 100*s* towards the considered microphone 100*m* bearing the index i. Thus, it is possible to write that the vector of the pressure gradient captured by the microphone 100*m* bearing the index i meets:

$$B_i \ \% \ \frac{1}{d^2(x_i(t),\ x_s(t))}(x_i(t) - x_s(t)). \qquad \text{[Math 2]}$$

with:

- $x_i(t)=(x_i(t)\ y_i(t)\ z_i(t))^T$ a vector representative of the position of the microphone 100*m* bearing the index i;
- $x_s(t)=(x_s(t)\ y_s(t)\ z_s(t))^T$ a vector representative of the position of the active source 100*s*; and
- $d(x_i(t),\ x_s(t))$ is the distance between the microphone 100*m* bearing the index i and the active source 100*s*.

In this instance, the equation [Math 2] simply reflects the fact that for a plane wave:

- The first-order component (i.e. the pressure gradient vector) of the encoded sound field is directed in the "source-capture point" direction; and
- The amplitude of the sound field decreases linearly with the distance.

At a first glance, the distance $d(x_i(t),x_s(t))$ is unknown, but it is possible to observe that, assuming a unique plane wave, the instantaneous acoustic pressure $W_i(t)$ at the microphone 100*m* bearing the index i is, in turn, inversely proportional to this distance. Thus:

$$W_i(t) \ \% \frac{1}{d(x_i(t),\ x_s(t))}$$

By substituting this relationship in [Math 2], the following proportional relationship is obtained:

$$B_i \% W_i^2(t)(x_i(t) - x_s(t))$$

By replacing the relationship the latter relationship in [Math 1], the following equation is obtained:

$$\sum_i a_i(t) W_i^2(t)(x_i(t) - x_s(t)) = W_a^2(t)(x_a(t) - x_s(t)),$$

with $x_a(t)=(x_a(t)\ y_a(t)\ z_a(t))^T$ a vector representative of the interpolation position in the aforementioned reference frame. By reorganizing, we obtain:

$$\sum_i a_i(t) W_i^2(t) x_i(t) - W_a^2(t) x_a(t) = \left(\sum_i a_i(t) W_i^2(t) - W_a^2(t)\right) x_s(t). \qquad \text{[Math 3]}$$

In general, the aforementioned different positions (for example, of the active source 100*s*, of the microphones 100*m*, of the interpolation position, etc.) vary over time. Thus, in general, the weighting factors $a_i(t)$ are time-dependent. Estimating the weighting factors $a_i(t)$ amounts to solving a system of three linear equations (written hereinabove in the form of one single vector equation in [Math 3]). For the interpolation to remain coherent over time with the interpolation position which may vary over time (for example, the considered position corresponds to the position of the listener 110 who could move), it is carried out at different time points with a time resolution $T_a$ adapted to the speed of change of the interpolation position. In practice, a refresh frequency $f_a=1/T_a$ is substantially lower than the sampling frequency $f_s$ of the acoustic signals. For example, an update of the interpolation coefficients $a_i(t)$ every $T_a$=100 ms is quite enough.

In [Math 3], the square of the sound pressure at the interpolation position, $W_a^2(t)$, also called instantaneous acoustic power (or more simply instantaneous power), is an unknown, the same applies to the vector representative of the position $x_s(t)$ of the active source 100*s*.

To be able to estimate the weighting factors $a_i(t)$ based on a resolution of [Math 3], an estimate $\widehat{W_a^2}(t)$ of the acoustic power at the interpolation position is obtained for example.

A first approach consists in approaching the instantaneous acoustic power by that one captured by the microphone 100*m* that is the closest to the considered interpolation position, i.e.:

$$\widehat{W_a^2}(t) = W_k^2(t), \text{ where } k = \arg\left(\min_i (d(x_i(t),\ x_a(t)))\right).$$

In practice, the instantaneous acoustic power $W_k^2(t)$ may vary quickly over time, this may lead to a noisy estimate of the weighting factors $a_i(t)$ and to an instability of the interpolated stage. Thus, in some variants, the average or effective power captured by the microphone 100*m* that is the closest to the interpolation position over a time window around the considered time point, is calculated by averaging the instantaneous power over a frame of T samples:

$$\widehat{W_i^2}(t) = \frac{1}{T} \sum_{n=t-T}^{t} W_i^2(n),$$

where T corresponds to a duration of a few tens of milliseconds, or equal to the refresh time resolution of the weighting factors $a_i(t)$.

In other variants, it is possible to estimate the actual power by autoregressive smoothing in the form:

$$\widehat{W_t^2}(t)=\alpha_w\,\widehat{W_t^2}(t-1)+(1-\alpha_w)W_i^2(t),$$

where the forget factor $\alpha_w$ is determined so as to integrate the power over a few tens of milliseconds. In practice, values from 0.95 to 0.98 for sampling frequencies of the signal ranging from 8 kHz to 48 kHz achieves a good tradeoff between the robustness of the interpolation and its responsiveness to changes in the position of the source.

In a second approach, the instantaneous acoustic power $W_a^2(t)$ at the interpolation position is estimated as a barycentre of the N estimates $\widehat{W_t^2}(t)$ of the N instantaneous powers $W_i^2(t)$ of the N pressures captured by the selected N microphones 100*m*. Such an approach turns out to be more relevant when the microphones 100*m* are spaced apart from one another. For example, the barycentric coefficients are determined according to the distance $\|x_i(t)-x_a(t)\|_p$, where p is a positive real number and $\|\bullet\|_p$ is the L-p norm, between the interpolation position and the microphone 110*m* bearing the index i among the N microphones 100*m*. Thus, according to this second approach:

$$\begin{cases} \widehat{W_a^2}(t)=\sum_i \dfrac{\widehat{W_i^2}(t)}{\tilde{d}(x_i(t),x_a(t))} \\ \tilde{d}(x_i(t),x_a(t))=\dfrac{\|x_i(t)-x_a(t)\|_p}{\sum_j \|x_j(t)-x_a(t)\|_p} \end{cases}$$

where $\tilde{d}(x_i(t),x_a(t))$ is the normalised version of $\|x_i(t)-x_a(t)\|_p$ such that $\Sigma_i d(x_i(t),x_a(t))=1$. Thus, a coefficient weighting the estimate $\widehat{W_t^2}(t)$ of the instantaneous power $W_i^2(t)$ of the pressure captured by the microphone 110*m* bearing the index i, in the barycentric expression hereinabove and inversely proportional to a normalised version of the distance, in the sense of a L-p norm, between the position of the microphone bearing the index i outputting the pressure $W_i(t)$ and the interpolation position.

In some alternatives, the instantaneous acoustic power $W_a^2(t)$ at the interpolation position is directly estimated as a barycentre of the N instantaneous powers $W_i^2(t)$ of the N pressures captured by the N microphones 100*m*. In practice, this amounts to substitute $\widehat{W_t^2}(t)$ with $W_i^2(t)$ in the equation hereinabove.

Moreover, different options for the norm p may be considered. For example, a low value of p tends to average the power over the entire area delimited by the microphones 100*m*, whereas a high value tends to favour the microphone 100*m* that is the closest to the interpolation position, the case $p=\infty$ amounting to estimating by the power of the closest microphone 100*m*. For example, when p is selected equal to two, the decay law of the pressure of the sound field is met, leading to good results regardless of the configuration of the stage.

Moreover, the estimation of the weighting factors $a_i(t)$ based on a resolution of [Math 3] requires addressing the problem of not knowing the vector representative of the position $x_s(t)$ of the active source 100*s*.

In a first variant, the weighting factors $a_i(t)$ are estimated while neglecting the term containing the position of the source that is unknown, i.e. the right-side member in [Math 3]. Moreover, starting from the estimate of the power $\widehat{W_a^2}(t)$ and from the estimate $\widehat{W_t^2}(t)$ of the instantaneous power $W_i^2(t)$ captured by the microphones 100*m*, such a neglecting of the right-side member of [Math 3] amounts to solving the following system of three linear equations, written herein in the vector form:

$$\sum_i a_i(t)\widehat{W_t^2}(t)x_i=\widehat{W_a^2}(t)x_a(t). \qquad \text{[Math 4]}$$

Thus, it arises that the weighting factors $a_i(t)$ are estimated from:

- the interpolation position, represented by the vector $x_a(t)$
- the position of each of the N microphones 100*m*, represented by the corresponding vector $x_i(t)$, i from 1 to N, in the aforementioned reference frame;
- the N pressures $W_i(t)$, i from 1 to N, captured by the N microphones; and
- the estimated power $\widehat{W_a^2}(t)$ of the sound field at the interpolation position, $\widehat{W_t^2}(t)$ being actually estimated from the considered quantities as described hereinabove.

For example, [Math 4] is solved in the sense of mean squared error minimisation, for example by minimising the cost function $\|\Sigma_i a_i(t)\,\widehat{W_t^2}(t)x_i(t)-\widehat{W_a^2}(t)x_a(t)\|^2$. In practice, the solving method (for example, the Simplex algorithm) is selected according to the overdetermined (more equations than microphones) or underdetermined (more microphones than equations) nature.

In a second variant, the weighting factors $a_i(t)$ are no longer estimated while neglecting the term containing the unknown position of the source, i.e. the right-side member of [Math 3], but while constraining the search for the coefficients $a_i(t)$ around the hyperplan $\Sigma_i a_i(t)\,\widehat{W_t^2}(t)=\widehat{W_a^2}(t)$. Indeed, in the case where the estimate $\widehat{W_a^2}(t)$ is a reliable estimate of the actual power $W_a^2(t)$, imposing that the coefficients _$a_i(t)$ meet "to the best" the relationship $\Sigma_i a_i(t)\,\widehat{W_t^2}(t)=\widehat{W_a^2}(t)$ implies that the right-side member in [Math 3] is low, and therefore any solution that solves the system of equations [Math 4] properly rebuilds the pressure gradients.

Thus, in this second variant, the weighting factors $a_i(t)$ are estimated by solving the system [Math 4] with the constraint that $\Sigma_i a_i(t)\,\widehat{W_t^2}(t)=\widehat{W_a^2}(t)$. In the considered system, $\widehat{W_t^2}(t)$ and $\widehat{W_a^2}(t)$ are, for example, estimated according to one of the variants provided hereinabove. In practice, solving such a linear system with a linear constraint may be completed by the Simplex algorithm or any other constrained minimisation algorithm.

To accelerate the search, it is possible to add a constraint of positivity of the weighting factors $a_i(t)$. In this case, the weighting factors $a_i(t)$ are estimated by solving the system [Math 4] with the dual constraint that $\Sigma_i a_i(t)\,\widehat{W_t^2}(t)=\widehat{W_a^2}(t)$, and that $\forall i$, $a_i(t)\geq 0$. Moreover, the constraint of positivity of the weighting factors $a_i$ allows avoiding phase reversals, thereby leading to better estimation results.

Alternatively, in order to reduce the computing time, another implementation consists in directly integrating the hyperplan constraint $\Sigma_i a_i(t)\,\widehat{W_t^2}(t)=\widehat{W_a^2}(t)$ into the system [Math 4], which ultimately amounts to resolution of the linear system:

$$\begin{cases} \sum_i a_i(t)\hat{W}_t^2(t)x_i(t) = \hat{W}_a^2(t)x_a(t) \\ \alpha\sum_i a_i(t)\hat{W}_t^2(t) = \alpha\hat{W}_a^2(t) \end{cases} \quad \text{[Math 5]}$$

In this instance, the coefficient $\alpha$ allows homogenising the units of the quantities $\widehat{W_a^2}(t)x_a(t)$ and $\widehat{W_a^2}(t)$. Indeed, the considered quantities are not homogenous and, depending on the unit selected for the position coordinates (meter, centimeter, . . . ), the solutions will favor either the equations set $\Sigma_i a_i(t)\,\widehat{W_t^2}(t)x_i(t)=\widehat{W_a^2}(t)x_a(t)$, or the hyperplan $\Sigma_i a_i(t)\,\widehat{W_t^2}(t)=\widehat{W_a^2}(t)$. In order to make these quantities homogeneous, the coefficient $\alpha$ is, for example, selected equal to the L−2 norm of the vector $x_a(t)$, i.e. $\alpha=\|x_a(t)\|_2$, with $$\|x_a(t)\|_2 = \sqrt[2]{x_a^2(t) + y_a^2(t) + z_a^2(t)}\,.$$

In practice, it may be interesting to constrain even more the interpolation coefficients to meet the hyperplan constraint $\Sigma_i a_i(t)\,\widehat{W_t^2}(t)=\widehat{W_a^2}(t)$. This may be obtained by weighting the amplifying factor $\alpha$ by an amplification factor $\lambda>1$. The results show that an amplification factor $\lambda$ from 2 to 10 makes the prediction of the pressure gradients more robust.

Thus, we also note in this second variant that the weighting factors $a_i(t)$ are estimated from:

- the interpolation position, represented by the vector $x_a(t)$;
- the position of each of the N microphones 100*m*, each represented by the corresponding vector $x_i(t)$, i from 1 to N;
- the N pressures $W_i(t)$, i from 1 to N, captured by the N microphones; and
- the estimated power $\widehat{W_a^2}(t)$ of the sound field at the interpolation position, $\widehat{W_t^2}(t)$ being actually estimated from the considered quantities as described hereinabove.

As of now, the performances of the method of [FIG. 2] applied to a stage 300 comprising four microphones 400*m* and one source 300*s* disposed in a symmetrical configuration with respect to the stage 300 and to the four microphones 300*m* is presented, with reference to [FIG. 3*a*], [FIG. 3*b*] and [FIG. 3*c*].

More particularly, the four microphones 300*m* are disposed at the four corners of a room and the source 300*s* is disposed at the center of the room. The room has an average reverberation, with a reverberation time or $T_{60}$ of about 500 ms. The sound field captured by the microphones 300*m* is encoded in a form comprising a captured pressure and the associated pressure gradient vector.

The results obtained by application of the method of [FIG. 2] are compared with those obtained by application of the barycentre method suggested in the aforementioned conference article of A. Southern, J. Wells and D. Murphy and which has a substantially similar computing cost. The calculation of the coefficients $a_i(t)$ is adapted according to the distance of the interpolation position to the position of the microphone 300*m* bearing the corresponding index i:

$$a_i(t) = \frac{\|x_i(t) - x_a(t)\|_5}{\sum_{k=1}^{N} \|x_k(t) - x_a(t)\|_5}$$

The simulations show that this heuristic formula provides better results than the method with fixed weights suggested in the literature.

To measure the performance of the interpolation of the field, we use the intensity vector $\vec{I}(t)$ which theoretically should point in the direction opposite to the active source 300*s*. In [FIG. 3*b*] and [FIG. 3*c*] are respectively plotted the normalised intensity vectors $\vec{I}(t)\|\vec{I}(t)$, the actual ones and those estimated by the method of the prior art and by the method of [FIG. 2]. In the symmetrical configuration of the stage 300, we note a slighter bias of the method of [FIG. 2] in comparison with the method of the prior art, in particular at the boundary between two microphones 300*m* and outside the area delimited by the microphones 300*m*.

As of now, the performances of the method of [FIG. 2] applied to a stage 400 comprising four microphones 400*m* and one source 400*s* disposed in an asymmetrical configuration with respect to the stage 400 and to the four microphones 400*m* is presented, with reference to [FIG. 4*a*], [FIG. 4*b*] and [FIG. 4*c*].

More particularly, in comparison with the configuration of the stage 300 of [FIG. 3*a*], the four microphones 400*m* remain herein disposed at the four corners of a room while the source 400*s* is now offset with respect to the centre of the room.

In [FIG. 4*b*] and [FIG. 4*c*], are respectively plotted the normalised intensity vectors $\vec{I}(t)/\|\vec{I}(t)\|$, the actual ones and those estimated by the method of the prior art and by the method of [FIG. 2] for the configuration of the stage 400. We notice the robustness of the provided method: the sound field interpolated by the method of [FIG. 2] is coherent over the entire space, including outside the area delimited by the microphones 400 (close to the walls). In contrast, the field interpolated by the method of the prior art is incoherent over almost half the space of the stage 400 considering the divergence between the actual and estimated acoustic intensity represented in [FIG. 4*b*].

As of now, another embodiment of the method for interpolating the sound field captured by the microphones 100*m* of the stage 100 is presented, with reference to [FIG. 5].

According to the embodiment of [FIG. 5], the method comprises step E200 of selecting N microphones among the Nt microphones of the stage 100 described hereinabove with reference to [FIG. 2].

However, in other embodiments that are not illustrated in [FIG. 2], the selection step E200 is not implemented and steps E500, E210 and E510 discussed hereinbelow, are implemented based on the sound fields encoded by the set of Nt microphones 100*m*. In other words, N=Nt in these other embodiments.

Back to [FIG. 5], the considered embodiment is well suited to the case where several sources among the sources 100*s* are simultaneously active. In this case, the assumption of a full-band field resembling to a plane wave is no longer valid. Indeed, in an anechoic environment, the mix of two plane waves is not a plane wave—except in the quite particular case of the same source emitting from two points of the space equidistant from the capture point. In practice, the procedure for reconstructing the "full-band" field adapts to the prevailing source in the frame used for the calculation of the effective powers. This results in fast directional variations, and sometimes in incoherences in the location of the sources: when one source is more energetic than another one, the considered two sources are deemed to be located at the position of the more energetic source.

To avoid this, the embodiment of [FIG. 5] makes use of signals parsimony in the frequency domain. For example, for speech signals, it has been statistically proven that the frequency carriers of several speech signals are generally disjoined: that is to say most of the time, one single source is present in each frequency band. Thus, the embodiment of [FIG. 2] (according to any one of the aforementioned variants) can apply to the signal present in each frequency band.

Thus, at a step E500, for given encoded sound field among the N encoded sound fields output by the selected N microphones 100*m*, a transformation of the given encoded sound field is performed by application of a time-frequency transformation such as Fourier transform or a perfect or almost perfect reconstruction filter bank, such as quadrature mirror filters or QMF. Such a transformation outputs M field frequency components associated to the given encoded sound field, each field frequency component among the M field frequency components being located within a distinct frequency sub-band.

For example, the encoded field vector, $\psi_i$, output by the microphone bearing the index i, i from 1 to N, is segmented into frames bearing the index n, with a size T compatible with the steady state of the sources present in the stage.

$$\psi_i(n)=[\psi_i(t_n-T+1)\psi_i(t_n-T+2)\ldots\psi_i(t_n)].$$

For example, the frame rate corresponds to the reset rate $T_a$ of the weighting factors $a_i(t)$, i.e.:

$$t_{n+1}=t_n+E[T_a/T_s],$$

where Ts=1/fs is the sampling frequency of the signals and E[•] refers to the floor function.

Thus, the transformation is applied to each component of the vector $\psi_i$ representing the sound field encoded by the microphone 100*m* bearing the index i (i.e. is applied to the captured pressure, to the components of the pressure gradient vector, as well as to the high-order components present in the encoded sound field, where appropriate), to produce a time-frequency representation. For example, the considered transformation is a direct Fourier transform. In this manner, we obtain for the l-th component $\psi_{i,l}$ of the vector $\psi_i$:

$$\psi_{i,l}(n,\omega)=\frac{1}{T}\sum_{t=0}^{T-1}\psi_{i,l}(t_n-t)e^{-j\omega t}$$

where $j=\sqrt{-1}$, and ω the normalised angular frequency.

In practice, it is possible to select T as a power of two (for example, immediately greater than $T_a$) and select $\omega=2\pi k/T$, $0\leq k<T$ so as to implement the Fourier transform in the form of a fast Fourier transform $$\psi_{i,l}(n,k)=\frac{1}{T}\sum_{t=0}^{T-1}\psi_{i,l}(t_n-t)e^{-\frac{2j\pi kt}{T}}$$

In this case, the number of frequency components M is equal to the size of the analysis frame T. When $T>T_a$, it is also possible to apply the zero-padding technique in order to apply the fast Fourier transform. Thus, for a considered frequency sub-band ω (or k in the case of a fast Fourier transform), the vector constituted by all of the components $\psi_{i,l}(n,\omega)$, (ou $\psi_{i,l}(n,k)$) for the different l, represents the frequency component of the field $\psi_i$ within the considered frequency sub-band ω (or k).

Moreover, in other variants, the transformation applied at step E500 is not a Fourier transformation, but an (almost) perfect reconstruction filter bank, for example a filter bank:

- QMF (standing for "Quadrature Mirror Filter");
- PQMF (standing for "Pseudo—Quadrature Mirror Filter"); or
- MDCT (standing for "Modified Discrete Cosine Transform").

Back to [FIG. 5], the transformation implemented at step E500 is repeated for the N sound fields encoded by the selected N microphones 100*m*, outputting N corresponding sets of M field frequency components.

In this manner, steps E210 and E210*a* described hereinabove with reference to [FIG. 2] (according to any one of the aforementioned variants) are implemented for each frequency sub-band among the M frequency sub-bands. More particularly, for a given frequency sub-band among the M frequency sub-bands, the interpolation outputs a field frequency component interpolated at the interpolation position and located within the given frequency sub-band. The interpolated field frequency component is expressed as a linear combination of the N field frequency components, among the N sets, located within the given frequency sub-band. In other words, the resolution of the systems of equations allowing determining the weighting factors (i.e. [Math 4] in the aforementioned constraints alternatives (i.e. hyperplan and/or positive weighting factors) and [Math 5]) is performed in each of the frequency sub-bands to produce one set of weighting factors per frequency sub-band $a_i(n,\omega)$ (or $a_i(n,k)$).

For example, in order to implement the resolution of the systems [Math 4] or [Math 5], the effective power of each frequency sub-band is estimated either by a rolling average:

$$\widehat{W_i^2}(n,\omega)=\frac{1}{P}\sum_{p=n-P+1}^{n}|W_i^2(p,\omega)|,$$

or by an autoregressive filtering:

$$\widehat{W_i^2}(n,\omega)=\alpha_w\widehat{W_i^2}(n-1,\omega)+(1-\alpha_w)|W_i^2(n,\omega)|.$$

Thus, the interpolation repeated for the M frequency sub-bands outputs M interpolated field frequency components at the interpolation position, each interpolated field frequency component among the M interpolated field frequency components being located within a distinct frequency sub-band.

Thus, at a step E510, an inverse transformation of the transformation applied at step E500 is applied to the M interpolated field frequency components outputting the interpolated encoded sound field at the interpolation position.

For example, considering again the example provided hereinabove where the transformation applied at step E500 is a direct Fourier transform, the inverse transformation applied at step E510 is an inverse Fourier transform.

As of now, a method for rendering the sound field captured by the microphones 100*m* of FIG. 1 to the listener 110 according to an embodiment of the invention is presented, with reference to [FIG. 6].

More particularly, at a step E600, the sound field is captured by the microphones 110*m*, each microphone among the microphones 110*m* outputting a corresponding captured sound field;

At a step E610, each of the captured sound fields is encoded in a form comprising the captured pressure and an associated pressure gradient vector.

In other non-illustrated embodiments, the sound field captured by the microphones 110*m* is encoded in a form comprising the captured pressure, an associated pressure gradient vector as well as all or part of the higher order components of the sound field decomposed in the ambisonic format.

Back to [FIG. 6], the rendering method comprises an interpolation phase E620 corresponding to the implementation of the interpolation method according to the invention (according to any one of the embodiments and/or variants described hereinabove with reference to [FIG. 2] and [FIG. 5]) outputting the interpolated encoded sound field at the interpolation position, for example the position of the listener 110.

At a step E630, the interpolated encoded sound field is compressed, for example by implementing an entropic encoding. Thus, a compressed interpolated encoded sound field is output. For example, the compression step E630 is implemented by the device 700 (described hereinbelow with reference to FIG. 7) which is remote from the rendering device 110*hp*.

Thus, at a step E640, the compressed interpolated encoded sound field output by the device 700 is transmitted to the rendering device 110*hp*. In other embodiments, the compressed interpolated encoded sound field is transmitted to another device provided with a computing capacity allowing decompressing a compressed content, for example a smartphone, a computer, or any other connected terminal provided with enough computing capacity, in preparation for a subsequent transmission.

Back to [FIG. 6], at a step E650, the compressed interpolated encoded sound field received by the rendering device 110*hp* is decompressed in order to output the samples of the interpolated encoded sound field in the used encoding format (i.e. in the format comprising at least the pressure captured by the corresponding microphone 110*m*, the components of the pressure gradient vector, as well as the higher-order components present in the encoded sound field, where appropriate).

At a step E660, the interpolated encoded sound field is rendered on the rendering device 110*hp*.

Thus, when the interpolation position corresponds to the physical position of the listener 110, the latter feels as if the sound field rendered to him is coherent with the sound sources 100*s* (i.e. the field rendered to him actually arrives from the direction of the sound sources 100*s*).

In some embodiments that are not illustrated in [FIG. 6], the compression E630 and decompression E650 steps are not implemented. In these embodiments, it is the raw samples of the interpolated encoded sound field which are actually transmitted to the rendering device 110*hp*.

In other embodiments that are not illustrated in [FIG. 6], the device 700 implementing at least the interpolation phase E620 is embedded in the rendering device 110*hp*. In this case, it is the samples of the encoded sound field (once compressed, or not, depending on the variants) which are actually transmitted to the rendering device 110*hp* at step E640, and not the samples of the interpolated encoded sound field (once compressed, or not, depending on the variants). In other words, in these embodiments, step E640 is implemented just after the capturing and encoding steps E600 and E610.

As of now, an example of a structure of a rendering device 700 according to an embodiment of the invention is presented, with reference to [FIG. 7].

The device 700 comprises a random-access memory 703 (for example a RAM memory), a processing unit 702 equipped for example with a processor, and driven by a computer program stored in a read-only memory 701 (for example a ROM memory or a hard disk). Upon initialisation, the computer program code instructions are loaded for example in the random-access memory 703 before being executed by the processor of the processing unit 702.

This [FIG. 7] illustrates only a particular manner, among several possible ones, to make the device 700 in order to perform some steps of the interpolation method according to the invention (according to any one of the embodiments and/or variants described hereinabove with reference to [FIG. 2] and [FIG. 5]). Indeed, these steps may be carried out indifferently on a reprogrammable computing machine (a PC computer, a DSP processor or a microcontroller) executing a program comprising a sequence of instructions, or on a dedicated computing machine (for example a set of logic gates such as a FPGA or an ASIC, or any other hardware module).

In the case where the device 700 is made with a reprogrammable computing machine, the corresponding program (that is to say the sequence of instructions) may be stored in a storage medium, whether removable (such as a floppy disk, a CD-ROM or a DVD-ROM) or not, this storage medium being partially or totally readable by a computer or processor.

Moreover, in some embodiments discussed hereinabove with reference to [FIG. 6], the device 700 is also configured to implement all or part of the additional steps of the rendering method of [FIG. 6] (for example, steps E600, E610, E630, E640, E650 or E660).

Thus, in some embodiments, the device 700 is included in the rendering device 110*hp*.

In other embodiments, the device 700 is included in one of the microphones 110*m* or is duplicated in several ones of the microphones 110*m*.

Still in other embodiments, the device 700 is included in a piece of equipment remote from the microphones 110*m* as well as from the rendering device 110*hp*. For example, the remote equipment is a MPEG-H 3D decoder, a contents server, a computer, etc.

The invention claimed is:

1. A method comprising:

receiving a sound field captured by a plurality of N microphones each outputting said sound field encoded in a form comprising at least one captured pressure and an associated pressure gradient vector; and interpolating said sound field at an interpolation position outputting an interpolated encoded sound field as a linear combination of said N encoded sound fields each weighted by a corresponding weighting factor, wherein said interpolating comprises estimating said N weighting factors at least from:

said interpolation position;

a position of each of said N microphones;

said N pressures captured by said N microphones; and an estimated power of said sound field at said interpolation position.

2. The method according to claim 1, wherein said estimating implements a resolution of the equation $\Sigma_i a_i(t)\,\widehat{W_t^2}(t)\,x_i(t)=\widehat{W_a^2}(t)x_a(t)$, with:

$x_i(t)$ being a vector representative of said position of the microphone an index i among said N microphones;

$x_a(t)$ being a vector representative of said interpolation position;

$\widehat{W_a^2}(t)$ being said estimate of the power of said sound field at said interpolation position;

$\widehat{W_t^2}(t)$ being, an estimate of instantaneous power $W_i^2(t)$ of said pressure captured by said microphone bearing the index i; and $a_i(t)$ being the N weighting factors.

3. The method according to claim 2, wherein said resolution is performed with the constraint that $\Sigma_i a_i(t)\,\widehat{W_t^2}(t)=\widehat{W_a^2}(t)$.

4. The method according to claim 3, wherein said resolution is further performed with the constraint that of the N weighting factors $a_i(t)$ are positive or zero.

5. The method according to claim 2, wherein said estimation also implements a resolution of the equation $\alpha\Sigma_i a_i(t)\,\widehat{W_t^2}(t)=\alpha\,\widehat{W_a^2}(t)$, with $\alpha$ being a homogenisation factor.

6. The method according to claim 2, wherein said estimating comprises:

a time averaging of said instantaneous power $W_i^2(t)$ over a predetermined period of time outputting said estimate $\widehat{W_t^2}(t)$; or an autoregressive filtering of time samples of said instantaneous power $W_i^2(t)$, outputting said estimate $\widehat{W_t^2}(t)$.

7. The method according to claim 2, wherein said estimate $\widehat{W_a^2}(t)$ of the power of said sound field at said interpolation position is estimated from said instantaneous sound power $W_i^2(t)$ captured by that one among said N microphones the closest to said interpolation position or from said estimate $\widehat{W_t^2}(t)$ of said instantaneous sound power $W_i^2(t)$ captured by that one among said N microphones the closest to said interpolation position.

8. The method according to claim 2, wherein said estimate $\widehat{W_a^2}(t)$ of the power of said sound field at said interpolation position is estimated from a barycentre of said N instantaneous sound powers $W_i^2(t)$ captured by said N microphones, respectively from a barycentre of said N estimates $\widehat{W_t^2}(t)$ of said N instantaneous sound powers $W_i^2(t)$ captured by said N microphones, a coefficient weighting the instantaneous sound power $W_i^2(t)$, respectively weighting the estimate $\widehat{W_t^2}(t)$ of the instantaneous sound power $W_i^2(t)$ captured by said microphone bearing the index i, in said barycentre being inversely proportional to a normalised version of the distance between the position of said microphone bearing the index i outputting said pressure $W_i(t)$ and said interpolation position, said distance being expressed in the sense of a L-p norm.

9. The method according to claim 1, further comprising, prior to said interpolating, selecting said N microphones among Nt microphones, Nt>N.

10. The method according to claim 9, wherein the N selected microphones are those the closest to said interpolation position among said Nt microphones.

11. The method according to claim 9, wherein said selecting comprises:

selecting two microphones bearing the indexes $i_1$ and $i_2$ the closest to said interpolation position among said Nt microphones;

calculating a median vector $u_{12}(t)$ having as an origin said interpolation position and pointing between the positions of the two microphones bearing the indexes $i_1$ and $i_2$; and determining a third microphone bearing the index $i_3$ different from said two microphones bearing the indexes $i_1$ and $i_2$ among the Nt microphones and whose position is the most opposite to the median vector $u_{12}(t)$.

12. The method according to claim 1, further comprising, for given encoded sound field among said N encoded sound fields output by said N microphones, transforming said given encoded sound field by application of a perfect reconstruction filter bank outputting M field frequency components associated to said given encoded sound field, each field frequency component among said M field frequency components being located in a distinct frequency sub-band, said transforming being repeated for said N encoded sound fields outputting N corresponding sets of M field frequency components, wherein, for a given frequency sub-band among said M frequency sub-bands, said interpolating outputs a field frequency component interpolated at said interpolation position and located within said given frequency sub-band, said interpolated field frequency component being expressed as a linear combination of said N field frequency components, among said N sets, located in said given frequency sub-band, and said interpolating being for said M frequency sub-bands outputting M interpolated field frequency components at said interpolation position, each interpolated field frequency component among said M interpolated field frequency components being located in a distinct frequency sub-band.

13. The method according to claim 12, further comprising an inverse transformation of said transformation, said inverse transformation being applied to said M interpolated field frequency components outputting said interpolated encoded sound field at said interpolation position.

14. The method of claim 1, further comprising:

capturing said sound field by the plurality of N microphones each outputting the corresponding captured sound field;

encoding of each of said captured sound fields outputting a corresponding encoded sound field in the form comprising the at least one captured pressure and associated pressure gradient vector;

performing an interpolation phase comprising the interpolating and outputting said interpolated encoded sound field at said interpolation position;

compressing said interpolated encoded sound field outputting a compressed interpolated encoded sound field;

transmitting said compressed interpolated encoded sound field to at least one rendering device;

decompressing said received compressed interpolated encoded sound field; and rendering said interpolated encoded sound field on said at least one rendering device.

15. A non-transitory computer-readable medium comprising program code instructions stored thereon for implementing a method of interpolating, when said program is executed on a computer, wherein the instructions configure the computer to:

receiving a sound field captured by a plurality of N microphones each outputting said sound field encoded in a form comprising at least one captured pressure and an associated pressure gradient vector; and interpolating said sound field at an interpolation position outputting an interpolated encoded sound field as a linear combination of said N encoded sound fields each weighted by a corresponding weighting factor, wherein said interpolating comprises estimating said N weighting factors at least from:

said interpolation position;

a position of each of said N microphones;

said N pressures captured by said N microphones; and an estimated power of said sound field at said interpolation position.

16. A device for interpolating a sound field captured by a plurality of N microphones each outputting said sound field encoded in a form comprising at least one captured pressure and an associated pressure gradient vector, said device comprising:

a reprogrammable computing machine or a dedicated computing machine, configured to:

receive sound field captured by the N microphones; and interpolate said sound field at an interpolation position outputting an interpolated encoded sound field expressed as a linear combination of said N encoded sound fields each weighted by a corresponding weighting factor, wherein said reprogrammable computing machine or said dedicated computing machine is further configured to estimate said N weighting factors from at least:

said interpolation position;

a position of each of said N microphones;

said N pressures captured by said N microphones, and an estimate of the power of said sound field at said interpolation position.

17. The device of claim 16, further comprising the plurality of N microphones.

18. The method of claim 1, further comprising capturing the sound field by the plurality of N microphones.

* * * * *